US009462884B2

(12) United States Patent
Hunter

(10) Patent No.: US 9,462,884 B2
(45) Date of Patent: Oct. 11, 2016

(54) SYSTEM AND METHOD FOR THE EFFICIENT USE OF SPACE AT CORNERS OF NINETY DEGREE INTERSECTION OF STORAGE MODALITIES IN NINETY DEGREES OR OTHERWISE

(71) Applicant: Western Dovetail Incorporated, Mare Island, Vallejo, CA (US)

(72) Inventor: Max Hunter, Vallejo, CA (US)

(73) Assignee: Western Dovetail Incorporated, Vallejo, CA (US)

( * ) Notice: Subject to any disclaimer, the term of this patent is extended or adjusted under 35 U.S.C. 154(b) by 0 days.

(21) Appl. No.: 14/598,212

(22) Filed: Jan. 15, 2015

(65) Prior Publication Data

US 2015/0196120 A1 Jul. 16, 2015

Related U.S. Application Data

(60) Provisional application No. 61/927,816, filed on Jan. 15, 2014.

(51) Int. Cl.

| | |
|---|---|
| ***A47B 81/00*** | (2006.01) |
| ***A47B 67/04*** | (2006.01) |
| ***A47B 88/04*** | (2006.01) |

(52) U.S. Cl.

CPC ..... *A47B 67/04* (2013.01); *A47B 81/002* (2013.01); *A47B 88/04* (2013.01)

(58) Field of Classification Search

CPC .... A47B 81/002; A47B 88/02; A47B 88/04; A47B 67/04; A47B 46/00; A47B 96/00

See application file for complete search history.

(56) References Cited

U.S. PATENT DOCUMENTS 1,108,082 A * 8/1914 Pennock ..... A47B 67/02 312/226
1,992,106 A * 2/1935 Wee ..... A47B 71/00 108/102

(Continued)

FOREIGN PATENT DOCUMENTS

JP 02233406 A * 9/1990
JP 04325108 A * 11/1992

(Continued)

*Primary Examiner* — Hanh V Tran

(74) *Attorney, Agent, or Firm* — Duane Morris LLP

(57) ABSTRACT

A drawer system in which two integrated drawer systems are deployed, such that each said drawer system is equipped with two separate heavy duty runner systems, at opposed ninety degree, or other angle. Each drawer system with an intervening platform upon which the second set of runners is mounted, such that, as a result, each involved drawer is capable of both lateral and forward and backward movement, with the result that the forward movement, in example, of one drawer, can open a space for the lateral movement of the second drawer. The first drawer, having been moved forward, can now be moved laterally, while the second drawer can then be moved forward. The end result being that they both become simultaneously accessible to the operator, all with the result that previously unavailable or unreachable space is rendered readily accessible, as to the contents contained in the second drawer.

8 Claims, 10 Drawing Sheets

(56) References Cited

U.S. PATENT DOCUMENTS 2,676,082 A * 4/1954 Merydith ..... A47B 49/006 292/76
2,755,155 A * 7/1956 Luss ..... A47B 17/033 312/198
2,780,926 A * 2/1957 Sharpe ..... F25D 23/10 312/301
4,582,372 A * 4/1986 Cooper ..... A47B 46/00 108/140
5,662,398 A * 9/1997 Swallow ..... A47B 67/04 312/238
5,752,756 A * 5/1998 Compagnucci ..... A47B 81/002 312/238
5,941,620 A * 8/1999 Weber ..... A47B 81/002 312/238
6,086,176 A * 7/2000 Aoyama ..... A47B 67/04 312/286
7,108,338 B2 * 9/2006 Katsuyama ..... A47B 67/04 312/301
8,083,303 B2 * 12/2011 Compagnucci ..... A47B 81/002 312/238
2006/0181183 A1 * 8/2006 Galloway ..... A47B 88/00 312/311

FOREIGN PATENT DOCUMENTS

JP 05146325 A * 6/1993
JP 05253025 A * 10/1993

* cited by examiner

Front View

SYSTEM AND METHOD FOR THE EFFICIENT USE OF SPACE AT CORNERS OF NINETY DEGREE INTERSECTION OF STORAGE MODALITIES IN NINETY DEGREES OR OTHERWISE

CROSS REFERENCES

This application is a non-provisional utility application of and claims benefit of provisional application No. 61/927,816, entitled "A SYSTEM AND METHOD FOR THE EFFICIENT USE OF SPACE OTHERWISE LOST TO USE AT SITUATIONS OF NINETY DEGREE INTERSECTION AT CORNERS BETWEEN CABINETS OR OTHER STORAGE MODALITIES IN NINETY DEGREE OR OTHERWISE IN CONFLICT OF LINE OF DRAWER TRAVEL FOR ADJOINING CABINETS OR SIMILAR MODALITIES, AT CORNERS" filed Jan. 15, 2014. The entirely thereof is incorporated herein by reference.

BACKGROUND

In any situation where cabinets line walls, including but not limited to where the walls involved meet at corners, large amounts of otherwise available space are lost to use because the direction of travel of the drawers from cabinets at both walls travel in ninety degree relationships to one another. This is illustrated in FIG. 1, which is a top view of under-counter cabinets at a corner, in the illustration there shown, in a kitchen. Essentially, a large cube of space is lost every time such as "blind corner" is encountered, with drawers conflicting in line of movement from one wall lining cabinet to another. Where the term "walls" is used here, it is intended to encompass all intersections of flat planes, vertical in relationship to the ground or floor, such that cabinetry involving drawers is placed upon one or both such walls, so that cubic storage space is lost in said blind corner. Additionally, due to the modular square drawers inherent to this system, with modules to be chosen in conformity with site demands, the chosen drawer sizes, most particularly the interior, or "two way slide" drawer, can be size tailored to the size requirements of specific sites, and therefore present the potential for far better space utilization than can be had by any "one size fits all" stacked circular rack configuration.

There have been prior attempts to address the issue of lost space at the ninety degree intersection of cabinets in corners, such as the "Lazy Susan" approach, of a stacked circular storage system. The current subject matter differs from all prior Art in that it allows the continued use of drawers in both cabinets, and the things stored in the otherwise lost space are accessible through a single drawer aperture. This brings several advantages, including more efficient utilization of the otherwise lost space (compared, for example, to a circular approach, being a "round peg" in a considerably larger "square hole." Other advantages include that the potential for lost items, and stuck items, is greatly reduced, as all remain contained in the involved drawer systems, from the time of placement until the time of removal, and in particular it is not necessary to have a lowered container height so as to accommodate hand access, since, in the within described system, all access to drawer contents, being the first encountered drawers, and those drawers which slide laterally prior to being brought into forward deployment, is from the top. This reduces spillage risk among other advantages.

While it is possible, and here claimed, that the Disclosed subject matter here filed can be used with drawers facing an open area (such that the drawer face, with pull, is visible to the operator), the highest and best use of this system and method is for installation of drawers within cabinets, and the cabinet enclosed variant of the Disclosed subject matter is here-described, without waiver of claims to same effect regarding drawers immediately visible from the interior of the room in which the corner drawers are situated. These and many other benefits of the disclosed subject matter will be readily apparent to one skilled in the art to which the invention pertains from a perusal of the claims, the appended drawings, and the following detailed description of the preferred embodiments.

BRIEF DESCRIPTION OF THE DRAWINGS

In FIG. 1, shows two drawers, one on the Left, and one on the Right. In this Figure, the drawer shown on the Left is the drawer occupying a portion of which would otherwise be lost space in a blind corner.

The following detailed description of preferred embodiments refers to the accompanying drawings, which illustrate specific embodiments of the disclosed subject matter. Other embodiments having different structures and operations do not depart from the scope of the present disclosed subject matter.

DETAILED DESCRIPTION

Figure 1:
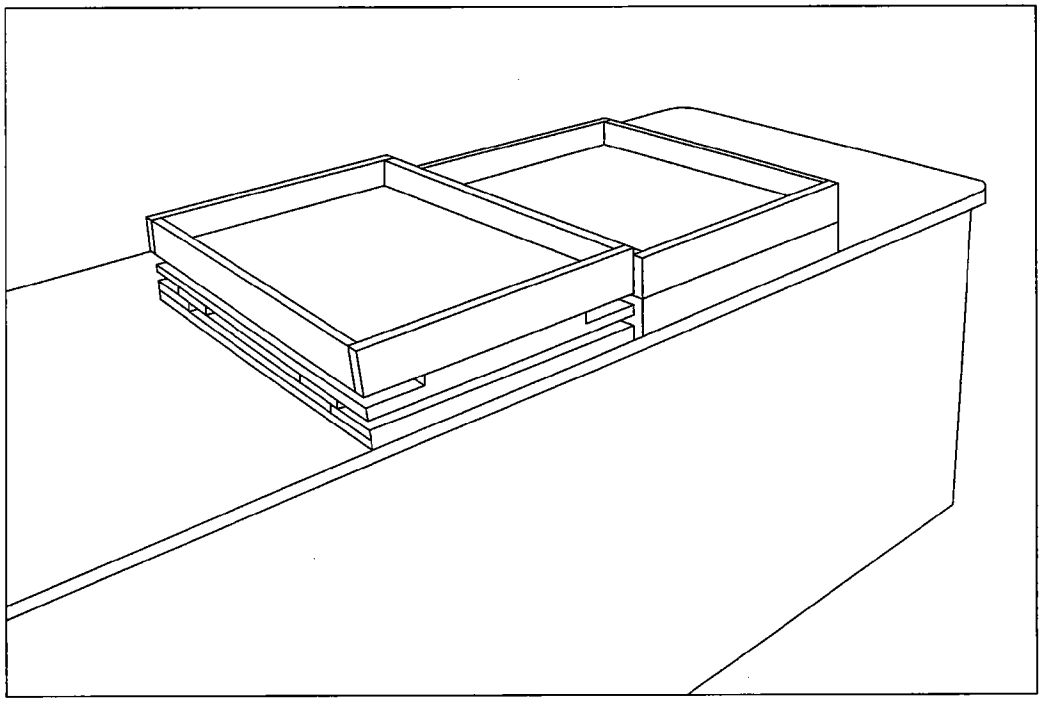
FIG. 1 shows the two adjacent drawers, each situated upon it separately and differently oriented set of double-tracked drawer runners. Due to the stresses upon the runners in full deployment, it is necessary that heavy duty runners be employed.

FIG. 1 shows the two adjacent drawers, each situated upon it separately and differently oriented set of double-tracked drawer runners. Due to the stresses upon the runners in full deployment, it is necessary that heavy duty runners be employed. In FIG. 1, shows two drawers, one on the Left, and one on the Right. In this Figure, the drawer shown on the Left is the drawer occupying a portion of which would otherwise be lost space in a blind corner. Throughout the following description, the drawer that is in the blind corner is referred to as the lost drawer, second drawer or Drawer B. The other drawer to the right is FIG. 1 is referred to as the front drawer, first drawer or Drawer A.

The disclosed subject matter described operates, at least in one embodiment, through the use of stacked system of drawer runners, such that the most interior drawer, herein titled Drawer B, occupies the corner position which is otherwise lost or unreachable space.

Drawer A or front drawer is the drawer visible to the exterior operator upon the opening of the cabinet, prior to the actuation of the Disclosed subject matter.

Figure 2:
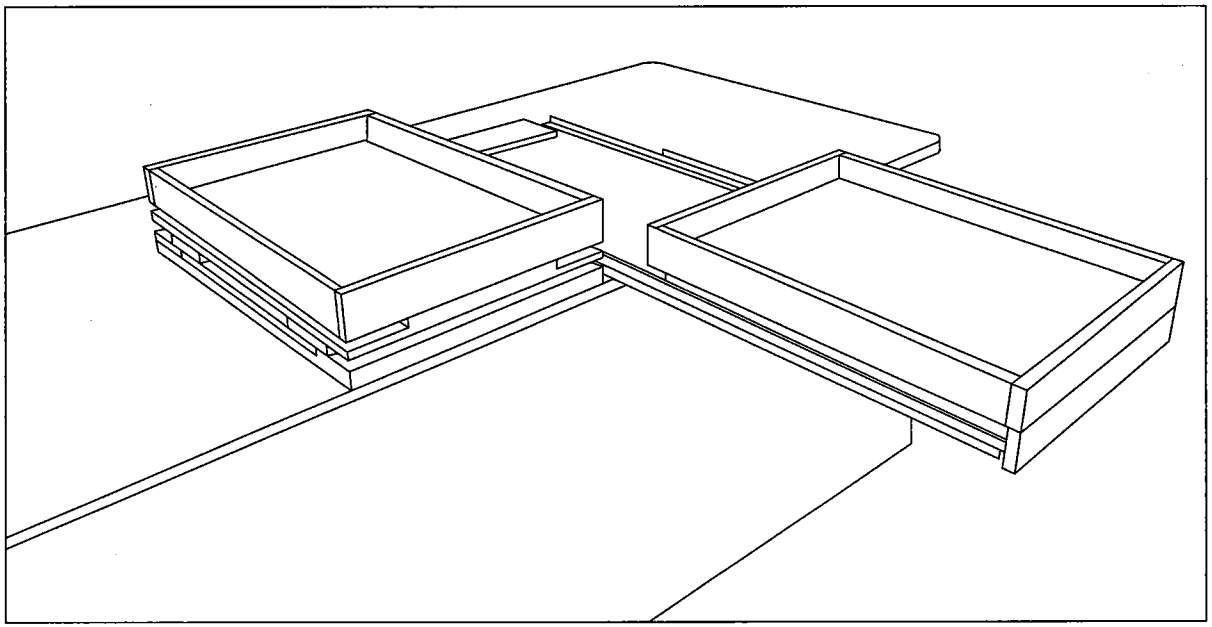
FIG. 2 shows Drawer A deployed Forward on the first of its underlying set of double-runners.
Figure 3:
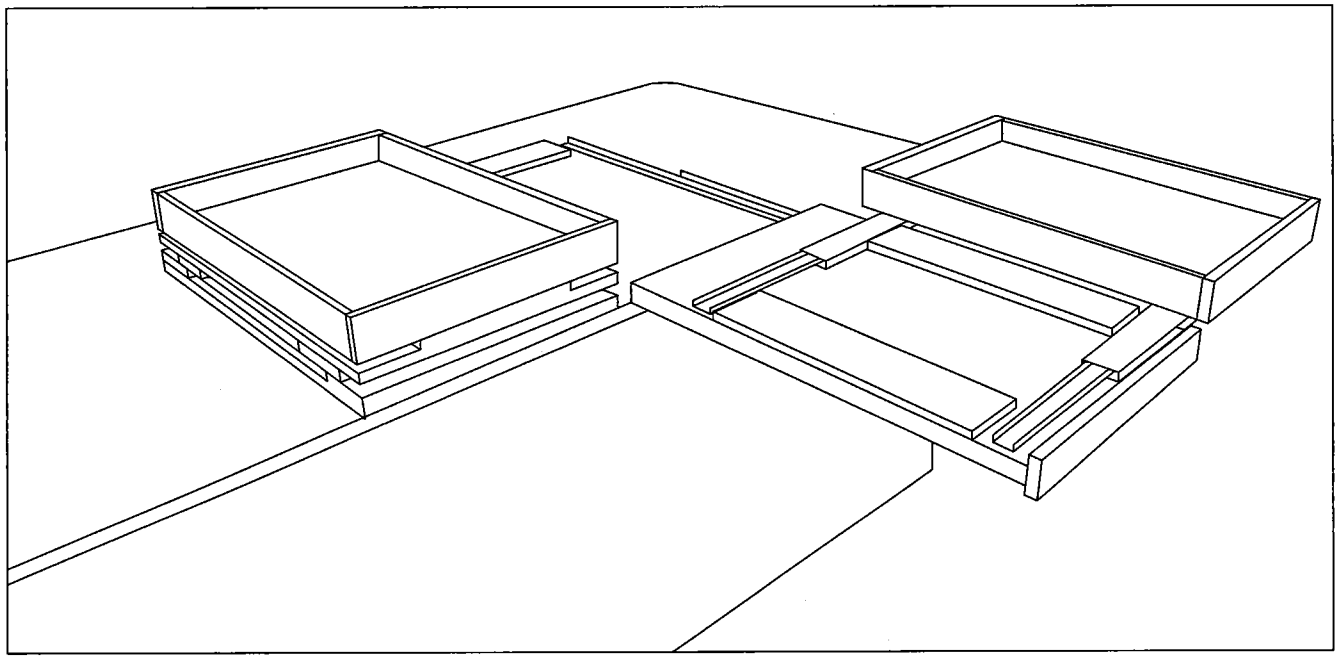
FIG. 3 shows Drawer A thereafter (after FIG. 2) deployed Right on its second set of underlying double-runners.
Figure 4:
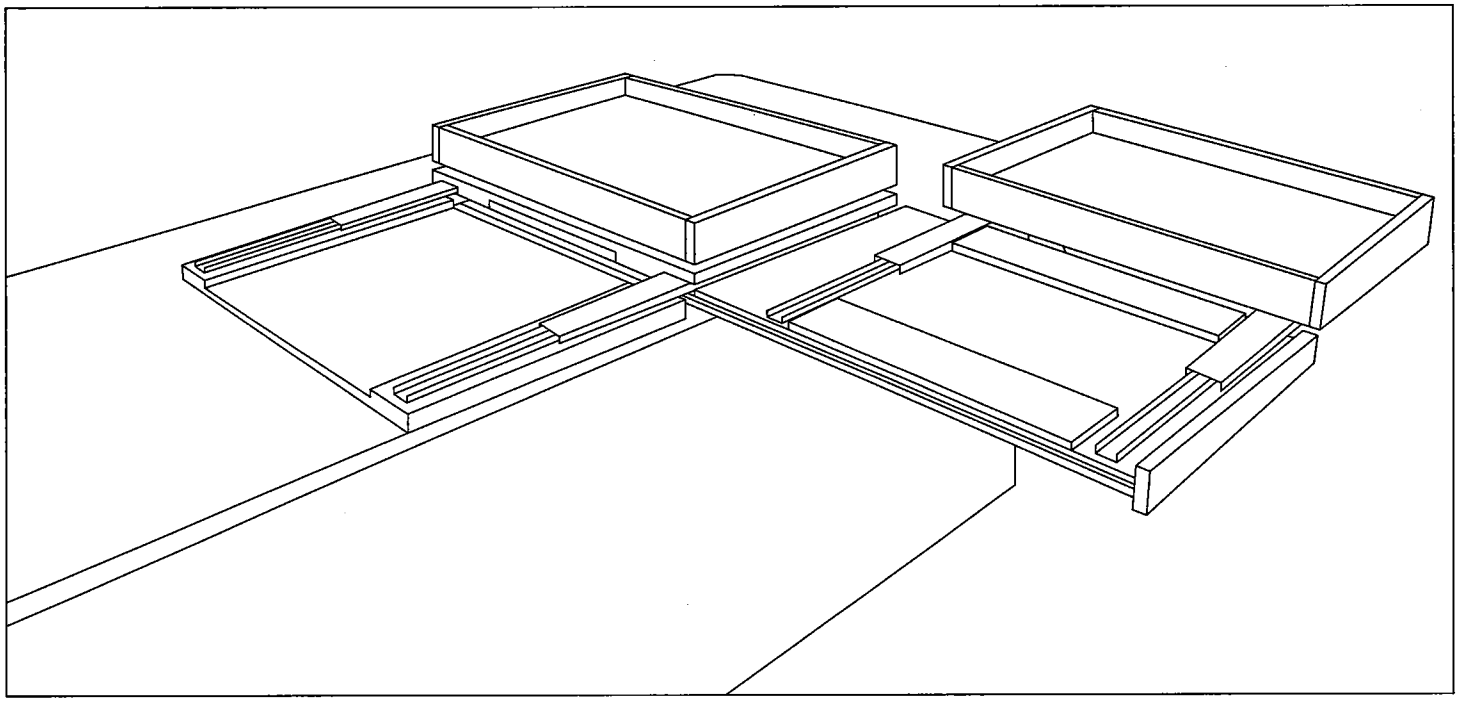
FIG. 4 shows Drawer B deployed to the Right, to the position-at-rest formerly occupied by Drawer A.
Figure 5:
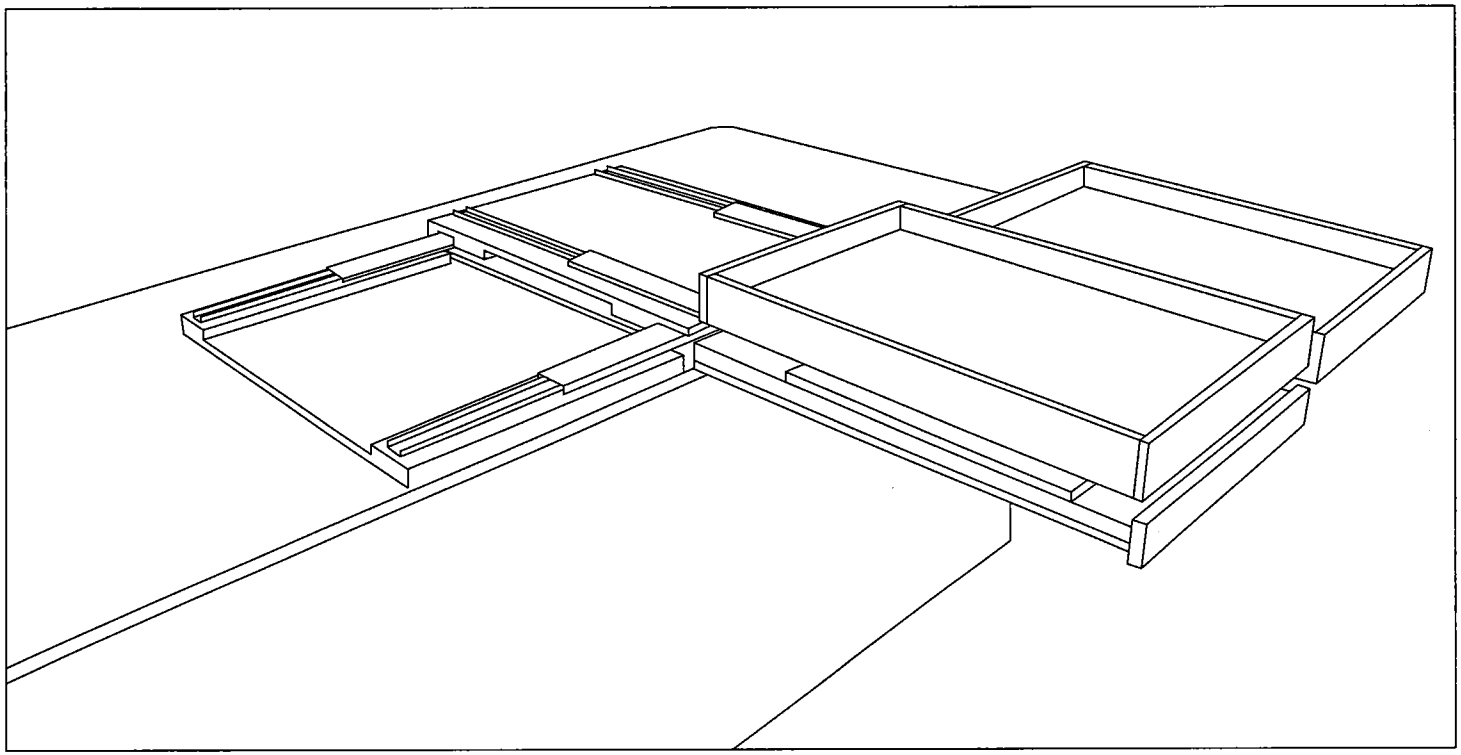
FIG. 5 shows Drawer B thereafter (after FIG. 4) deployed Forward. At this juncture, both Drawer A and Drawer B are outside of the cabinet, itself an additional value to the Disclosed subject matter, such that the contents of both Drawer A and Drawer B can be simultaneously accessed, and items also moved between them without any further opening of doors or drawers.
Figure 8:
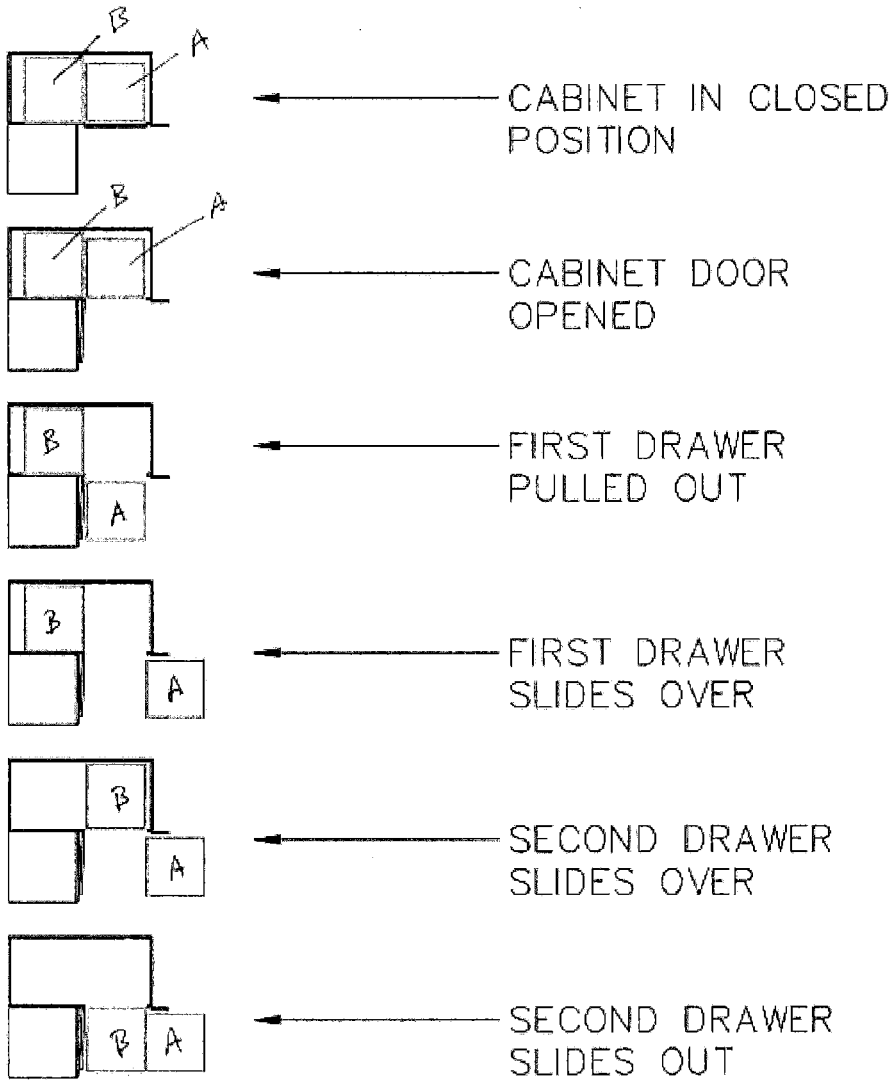
FIG. 8 shows a top view of the sequential arrangement and movement of several embodiments of the disclosed subject matter.

To use the disclosed subject matter, the operator draws the first-visible drawer (Front Drawer), here described as Drawer A, out forward in the normal manner in which one ordinarily opens a drawer. The drawer is situated upon metallic drawer runners, as shown in FIG. 2 and FIG. 8. The drawer system operates by stacking one system of mounted drawer runners over a second set of mounted drawer runners, such that Drawer A is drawn forward, and then, on its second set of mounted slides, moved to the right as shown in FIG. 3 and FIG. 8, and Drawer B (Lost Drawer) is moved laterally to the side, as shown in FIG. 4 and FIG. 8, and then, on its set of separately mounted slides, pulled forward, all the way to a parallel configuration contiguous to Drawer A, as shown in FIG. 5 and FIG. 8.

Thus, disclosed subject matter is a system and method which works through the use of heavy duty metallic drawer slides, which are otherwise of a sort typically used upon the sides of drawers, and deploying said slides, with separating stacked platforms as hereafter described, in ninety degree opposition to one another, such that hidden drawer (Drawer B, above) can be moved laterally into position upon one slide, and then the same drawer, due to the use of heavy duty slides and an intervening platform, can then be pulled forward, into the position opened by the movement of Drawer A, first forward and out of the cabinet, and then to the right on its own set of integrated double slides. The drawer slides may be made of any material possessing the applicable characteristics necessary such as strength, durability and cost. Furthermore, the lost spaces from obtuse or acute angles other than 90 degrees is also envisioned, with the changes being the orientation of the runners/slides to each other.

The operation of the Disclosed subject matter can be well understood through visualization from the attached illustrative FIGS. 1-5 with or without conjunction with FIG. 8.

Figure 6:
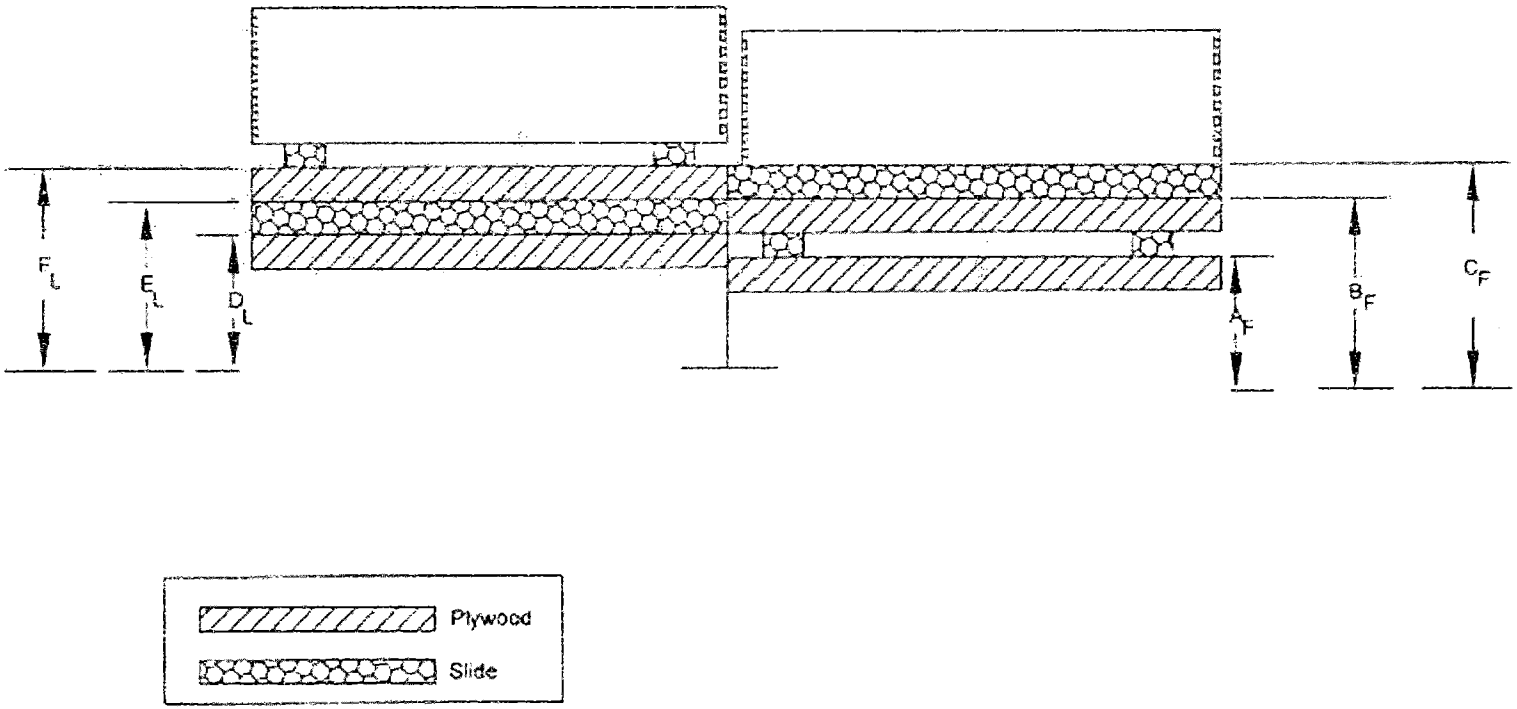
FIG. 6 shows the relative heights of the component parts of an embodiment of the disclosed subject matters.

As shown in FIG. 6, the relative vertical position of the components are shows with minimum requirements. The height from datum of the top of the Front Drawer lateral slide is given as $C_F$, the height of the top of the Front Drawer extending slide is given as $A_F$ and the height of the top of the Front Drawer platform is given as $B_F$.

Similarly from the FIG. 6 the bottom of the Lost Drawer lateral slide is given as $D_L$ the bottom of Lost Drawer platform is given as $E_L$, and the bottom of the Lost Drawer extending slide is shown as $F_L$.

The requirements for this embodiment of the disclosed subject matter, are: $F_L$ is greater or equal to $C_F$; and $D_L$ is greater or equal to $A_F$.

Figure 7:
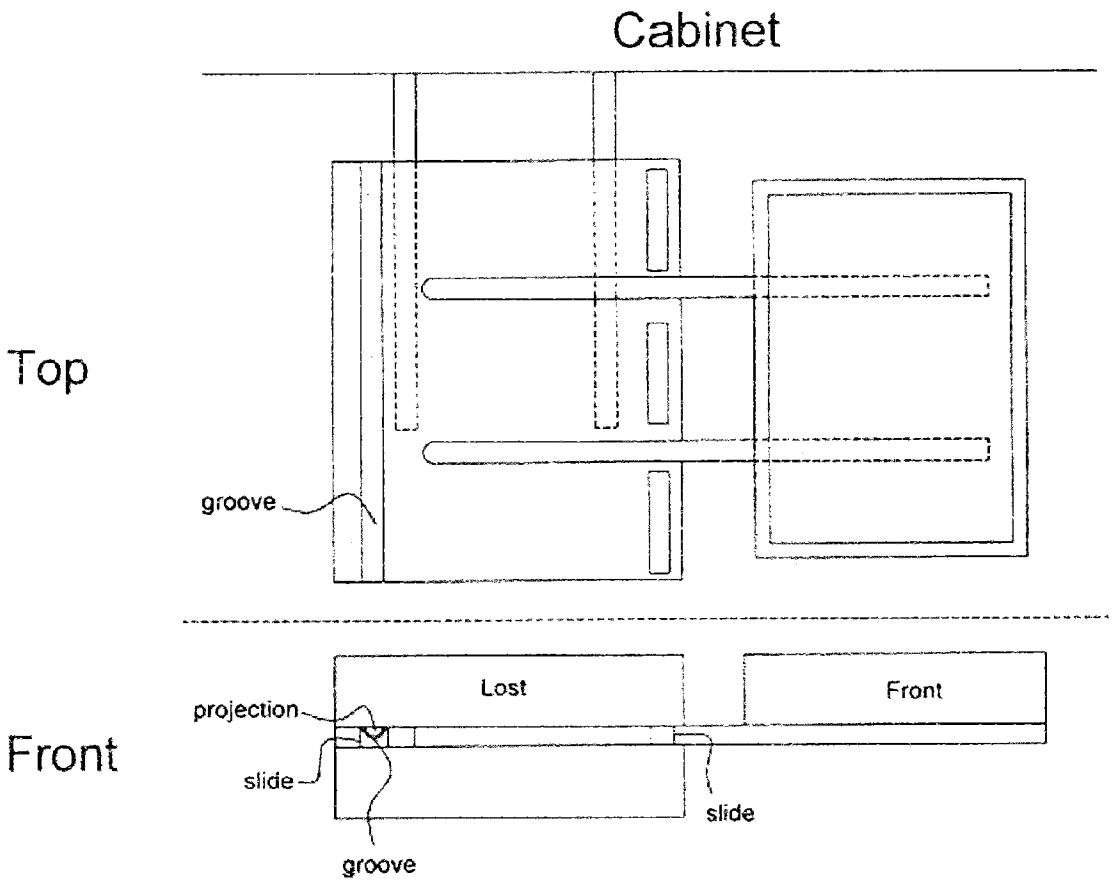
FIG. 7 shows another embodiment of the disclosed subject matter with a reduced number of drawer slides utilizing grooves and slides.

As shown in FIG. 7, the Lost corner extending slides may be replaced with a groove positioned on the Front Drawer extending platform with a corresponding projection on the bottom of the lost drawer. The groove on the slide and projection being made of a low friction material, Additionally other fixed sliding surfaces may be located between the Front Drawer lateral slides to support the weight of the Lost drawer when extended. In this manner, a smaller height of the system may be achieved since the bottom of the Lost corner Drawer may be equal to $C_F$ resulting in both the front drawer and Lost corner Drawer having bottoms of equal height, unlike that shown in FIGS. 5, 6 and FIG. 9.

Figure 9:
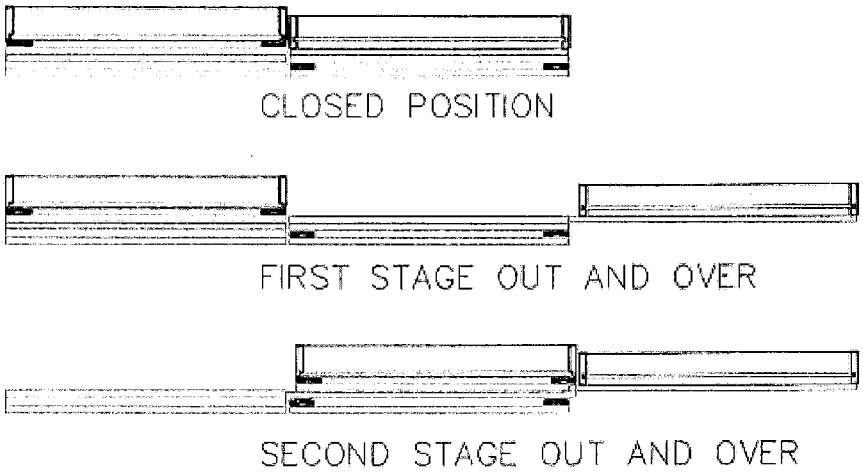
FIG. 9 shows a front view of the sequential arrangement and movement of several embodiments of the disclosed subject matter.
Figure 10:
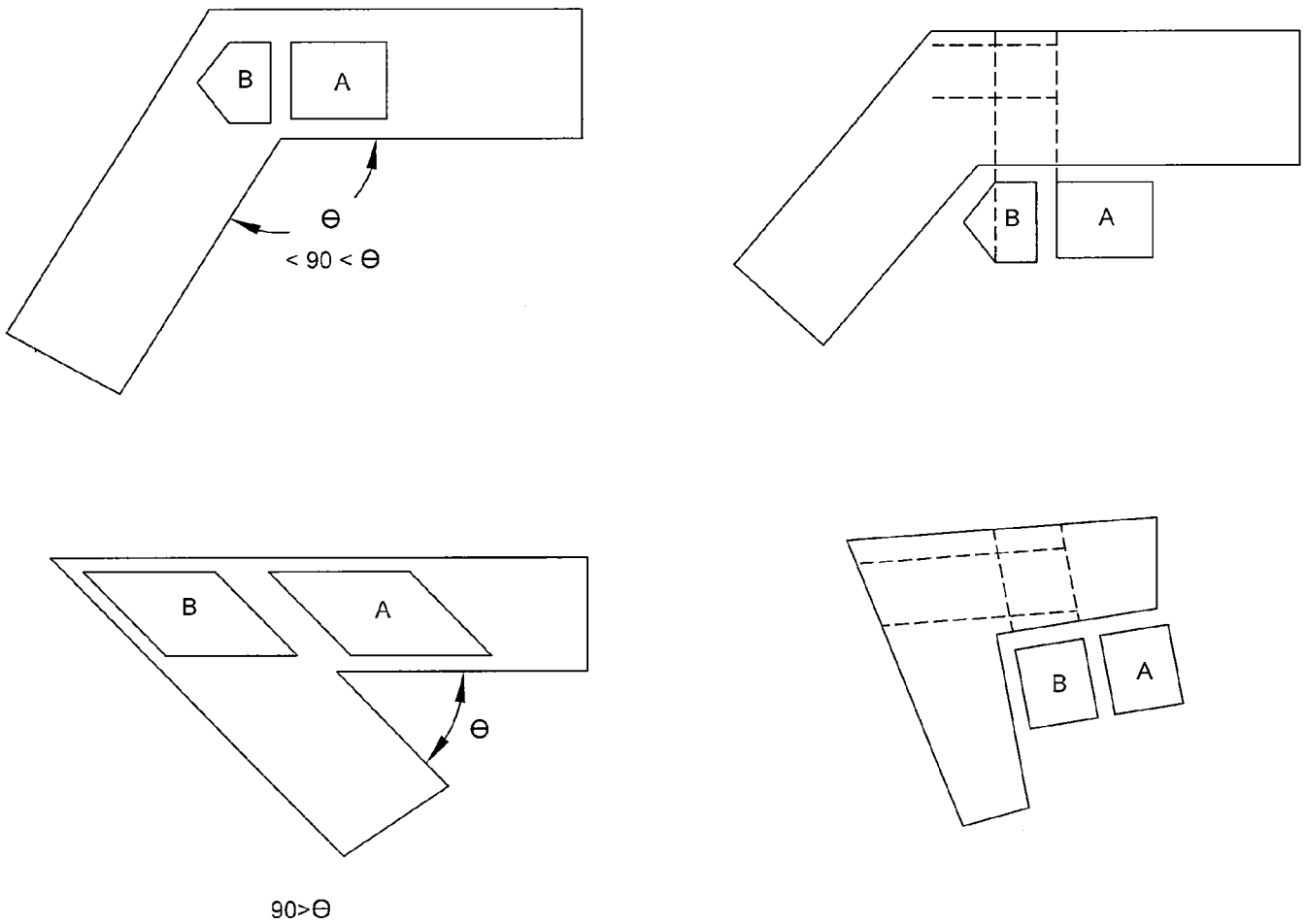
FIG. 10 shows embodiments wherein the angle is not ninety degrees.

FIG. 9 shows the front view of FIG. 1 the closed position, the first drawer being pulled out and over as shown in FIG. 3 and FIG. 8. FIG. 9 also shows the lost drawer being pushed over and pulled out as shown in FIGS. 5 and 8.

While pairs of lateral and extending slides are shown in the embodiments presented, single lateral and extending slides is also envisioned, as are multiple lateral and extending slides.

These systems as described may be stacked, such that for each front drawer there may be a lost drawer. For example a corner cabinet having three front drawers aligned vertically may also have three or more lost drawers, each associated with one of the front drawers.

Additionally, the lateral and extending slides may be incorporated within the bottom of the Drawers or top of the platforms or both, to further minimize the profile height, so long as the relationships described above are maintained. With respect to F, C, D and A.

With respect to the use of grooves and sliding surfaces, embodiments of the disclose subject matter can employ the use of a combination of extendable slides/runners and grooves, or grooves and sliding surfaces entirely for movement of the lost drawer, since the extending slides of the front drawer could provide the support necessary for the lost drawer.

An aspect of the disclosed subject matter is a drawer movement system, such that each involved drawer is equipped with two separate heavy duty runner systems, at opposed ninety degree angles, with an intervening platform upon which the second set of runners is mounted, such that, as a result, the involved drawer is capable of both lateral and forward and backward movement.

Another aspect of the disclosed subject matter is a drawer system in which two integrated drawer systems are deployed, such that each said drawer system is equipped with two separate heavy duty runner systems, at opposed ninety degree angles, each with an intervening platform upon which the second set of runners is mounted, such that, as a result, each involved drawer is capable of both lateral and forward and backward movement, with the result that the forward or axial movement, in example, of one drawer, can open a space for the lateral movement of the second drawer, and the first drawer, having been moved axially, can now be moved laterally, while the second drawer can be moved axially, such that they both become simultaneously accessible to the operator, all with the result that previously unavailable or unreachable space is rendered readily accessible, as to the contents therein.

While embodiments shown reflect a 90 degree arrangement, other arrangements less or greater than 90 degrees are also envisioned. For example a 30 degree angled corner.

Although the invention has been described in terms of exemplary embodiments, it is not limited thereto. Rather, the appended claims should be construed broadly, to include other variants and embodiments of the invention, which may be made by those skilled in the art without departing from the scope and range of equivalents of the invention.

What I claim is:

1. A drawer system for use in a corner, in which at least one of two cabinet faces that intersect to form the corner contains a first front facing drawer that is retractable into the cabinet in a direction perpendicular to the at least one cabinet face, the drawer system comprising:

a first drawer sub system comprising:

a first set of runners oriented perpendicular to the at least one cabinet face, attached on an upper surface to a first intermediate platform and on a lower surface to the cabinet;

a second set of runners oriented parallel to the at least one cabinet face, attached on an upper surface to the front facing drawer and on a lower surface to the first intermediate platform;

a second drawer sub system comprising:

a first set of second drawer runners oriented parallel to the at least one cabinet face, attached on an upper surface to a second intermediate platform and on a lower surface to the cabinet;

a second set of second drawer runners oriented perpendicular to the at least one cabinet face, attached on an upper surface to a second drawer and on a lower surface to the second intermediate platform;

wherein the respective runners allow relative movement of the upper and lower surfaces along the respective orientation; and wherein the first and second drawers are contained within the cabinet when retracted and side by side when in the extended position.

2. The drawer system of claim 1, wherein the corner is 90 degrees.

3. The drawers system of claim 1, wherein the corner is greater than 90 degrees.

4. A drawer system for use in a corner, in which at least one of two cabinet faces that intersect to form the corner contains a first front facing drawer that is retractable into the cabinet in a direction perpendicular to the at least one cabinet face, the drawer system comprising:

a first drawer sub system comprising:

a first set of runners oriented perpendicular to the at least one cabinet face, attached on an upper surface to a first intermediate platform and on a lower surface to the cabinet;

a second set of runners oriented parallel to the at least one cabinet face, attached on an upper surface to the front facing drawer and on a lower surface to the first intermediate platform;

a second drawer sub system comprising:

a first set of second drawer runners oriented parallel to the at least one cabinet face, attached on an upper surface to a second intermediate platform and on a lower surface to the cabinet;

a second set of second drawer runners oriented perpendicular to the at least one cabinet face, attached on an upper surface to a second drawer and on a lower surface to the first intermediate platform;

wherein the respective runners allow relative movement of the upper and lower surfaces along the respective orientation; and wherein the first and second drawers are contained within the cabinet when retracted and side by side when in the extended position.

5. The drawer system of claim 4, wherein the second set of second drawer runners comprise a groove.

6. The drawer system of claim 5, wherein the second set of second drawer runners comprise a projection adapted to be received by the groove.

7. The drawer system of claim 6, wherein the second set of second drawer runners further comprises a plurality of sliding surfaces.

8. The drawer system of claim 5, wherein the bottom of the first and second drawers are at the same high.

* * * * *